US006864799B2

(12) United States Patent
Popps et al.

(10) Patent No.: US 6,864,799 B2
(45) Date of Patent: Mar. 8, 2005

(54) EMERGENCY LIGHTING DEVICE FOR FIREFIGHTERS

(76) Inventors: Gregory S. Popps, 135 Skyview Ter., Syracuse, NY (US) 13219; Steven G. Pfleiderer, 114 Feldspar Dr., Syracuse, NY (US) 13219

( * ) Notice: Subject to any disclaimer, the term of this patent is extended or adjusted under 35 U.S.C. 154(b) by 48 days.

(21) Appl. No.: 10/421,323

(22) Filed: Apr. 23, 2003

(65) Prior Publication Data

US 2004/0212514 A1 Oct. 28, 2004

(51) Int. Cl.[7] ..... G08B 23/00

(52) U.S. Cl. ..... 340/693.5; 340/321; 340/691.4; 340/693.11; 362/259

(58) Field of Search ..... 340/693.5, 693.9, 340/693.11, 691.1, 691.4, 691.5, 815.4, 815.45, 815.75, 815.76, 321, 326, 332; 40/541; 362/259, 253, 368, 800

(56) References Cited

U.S. PATENT DOCUMENTS

| | | | | | |
|---|---|---|---|---|---|
| 4,107,766 | A | * | 8/1978 | Baker | 362/226 |
| 4,419,658 | A | * | 12/1983 | Jarosz et al. | 340/321 |
| 4,649,376 | A | | 3/1987 | Frank | 340/691 |
| 5,103,383 | A | | 4/1992 | Mayhew | 362/186 |
| 5,109,322 | A | * | 4/1992 | Loughlin | 362/253 |
| 5,177,461 | A | * | 1/1993 | Budzyna et al. | 340/332 |
| 5,216,418 | A | | 6/1993 | Lenz et al. | 340/815 |
| 5,572,183 | A | | 11/1996 | Sweeney | 340/332 |
| 5,898,363 | A | | 4/1999 | Altilio | 340/384.1 |
| 6,000,811 | A | * | 12/1999 | Bordak | 340/321 |
| 6,007,219 | A | * | 12/1999 | O'Meara | 362/259 |
| 6,222,455 | B1 | * | 4/2001 | Kaiser | 340/691.4 |
| 6,317,047 | B1 | | 11/2001 | Stein et al. | 340/573.1 |
| 6,724,467 | B1 | * | 4/2004 | Billmers et al. | 356/5.04 |
| 2004/0012962 | A1 | * | 1/2004 | Wolf | 362/259 |

* cited by examiner

*Primary Examiner*—Thomas Mullen
(74) *Attorney, Agent, or Firm*—Bernhard P. Molldrem, Jr.

(57) ABSTRACT

A safety device for firefighters to mark a viable exit for a building includes an audible sounder and a number of laser diodes in a housing with lenses that create panes or sheets of light. The housing of the device can have prongs that allow the device to pierce drywall to mount it near a door or window, as well as an adhesive or cement for mounting on other vertical surfaces. The housing is also has a tapered wedge shape and can wedge a door in an open position. There can be e.g. four laser diodes oriented at various angles.

10 Claims, 3 Drawing Sheets

EMERGENCY LIGHTING DEVICE FOR FIREFIGHTERS

BACKGROUND OF THE INVENTION

This invention concerns a safety device for firefighters, and is more particularly concerned with an emergency light and sounder for marking a window or door exit so that the firefighter can find the exit when the building itself is on fire and may be filled with smoke and flame.

Currently, audible and visual alarms and similar safety devices are needed for fire safety use. In particular, when a building is on fire, firefighters arriving at the scene have to enter various parts of the building to ensure that any victims who may be present inside the building can be led to safety. The firefighter may also have to enter the building to attack the fire itself from inside. In either event, when the firefighter enters through a door or window, it is imperative to mark the door or window so that he or she can find the exit. Visibility inside a burning building is limited because of heavy smoke or flame. The typical practice is to place a flashlight or lantern at the exit, with the beam of the lamp pointing in the direction from which the firefighter expects to exit later. This is not always satisfactory, because the smoke does not allow the flashlight beam or lantern beam to penetrate very far.

There have been several audible and visual beacons proposed previously, which could be employed for this purpose. Altilio U.S. Pat. No. 5,898,363 relates to a portable exit beacon with an audio oscillator and a strobe light under a dome on top of the unit. Mayhew U.S. Pat. No. 5,103,383 relates to an emergency flasher strobe light. Whitehead U.S. Pat. No. 5,243,506 relates to a light-guiding system for partly collimating a light beam, which can be used in a beacon. Puppo U.S. Pat. No. 6,137,396 relates to small visible marker comprising an LED and which can be directly attached to a 9V battery. None of these prior approaches provides a beam that will cut through the smoke of the burning building, and none of them includes any means for securing the beacon to a surface at or adjacent to the exit.

Another problem is that the small portable marker or beacon may need to be secured to a vertical surface, e.g., the wall next to a window or door, the frame of the window or door, or the door jamb, and in the case of a doorway, may also need to be used to wedge the doorway open. Of the devices that have been previously proposed, Stein et al. U.S. Pat. No. 6,317,047 shows one type of firefighter safety device which incorporates a hook-like arm that can be placed over a door hinge to keep the door in an open position. However, that device does not include any means for mounting it onto a vertical surface, or for wedging the door open anywhere but at the hinge side of the door.

OBJECTS AND SUMMARY OF THE INVENTION

Accordingly, it is an object of the present invention to provide a fire safety device that serves as an effective audible and visual beacon or marker, and which overcomes the drawbacks of conventional devices as described above.

It is also an object to provide an audible and visible tool to be used in the fire service as an aid for marking viable escape routes, such as windows and doors.

It is another object to provide a firefighter's exit beacon or marker, which provides a highly visible beacon that creates a visible-path for the firefighter back to the exit.

Likewise, it is an object to provide a firefighter's exit beacon or marker that provides sheets or panes of light in the room or space where the firefighter is working, so as to create lines of light on the walls and floor which lead back to the exit.

It is another object to provide a beacon or marker that can be installed on a wall or other vertical surface adjacent the window or door exit by the firefighter, and which will remain in place until the firefighter leaves the room or other space.

In accordance with one aspect of the present invention, a portable emergency lighting device permits a firefighter to mark a door or window exit to a building structure so that the firefighter entering the building structure can find the door or window exit as a means of escape. The device comprises a housing having a front portion and a back wall, with a plurality of ports or penetrations in the front portion. The visible beacon is provide by a plurality of laser diodes within the housing and positioned to emit their visible light through respective ones of the penetrations. An audible sounder is also mounted on the housing. A long-life battery or similar electrical power supply is situated within the housing and serves for powering the laser diodes and sounder. On the back wall of the housing there is structure that permits the firefighter to mount the portable emergency lighting device onto a vertical wall surface near the door or window. The device can be installed by the firefighter next to the window or door without use of additional tools. The audible sounder may be a buzzer, although an intermittent sound or chirp is easier to find than a constant tone, so an intermittent sound generator is preferred.

In a preferred embodiment, the housing front portion has a center wall portion, side wall portions angled about 45 degrees to the right and to the left, and a lower angulated wall portion angled about 45 degrees below horizontal, with at least one penetration through each of these wall portions. Respective ones of the laser diodes positioned to emit light through ones of said penetrations in center and angled wall portions. That is, the housing has a center wall portion, a left portion angled at about 135 degrees with respect to the center wall portion, a right portion angled at about 135 degrees in respect to the center wall portion, and a lower wall portion angulated at a 135 degree angle in respect to the center wall portion.

For at least one, and preferably for each of these penetrations there is a lens for converting the beam of light of the associated laser diode into a flat pane of light. That is, the lens causes the very thin pencil beam to fan out, so as to create lines of light where the laser light reaches the walls and floor of the room, and these can be followed back to the beacon and to the exit that it marks.

The structure on the housing that permits the firefighter to mount the device onto a vertical wall surface may preferably include one or more swing-up prongs on the housing back wall. These prongs are capable of penetrating drywall or other wall material to hold the device in place next to the door or window. The prongs lie flat against the back wall of the housing until needed, and then swing or pivot up to a horizontal position. However, in the event that the wall is of a harder material, an adhesive pad on the back wall can be used to adhere the device to the wall. A loop of a flexible cord, e.g., a durable steel cable, can be mounted through eyes on the housing so that the device can be hung from any convenient member protruding from the wall or other surface next to the door or window.

The tapered wedge shape of the housing also permits the device to be used for wedging the door into an open position.

Also, when ventilating, i.e., breaking a window to release toxic fumes, the fire fighter may place this tool under the window to mark it. As the smoke lifts off the floor, the laser pane will illuminate beneath the smoke and draw a line on the floor. An interior fire fighter can see the laser pane that is illuminated onto the floor. The fire fighter may have a view of several of the panes, and can follow them back to the source, because all of them will merge at the window.

While a preferred embodiment is shown and describe here, it is also possible to use other arrangements, if desired, with housings of a different shape, or with prongs or blades of a different type.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
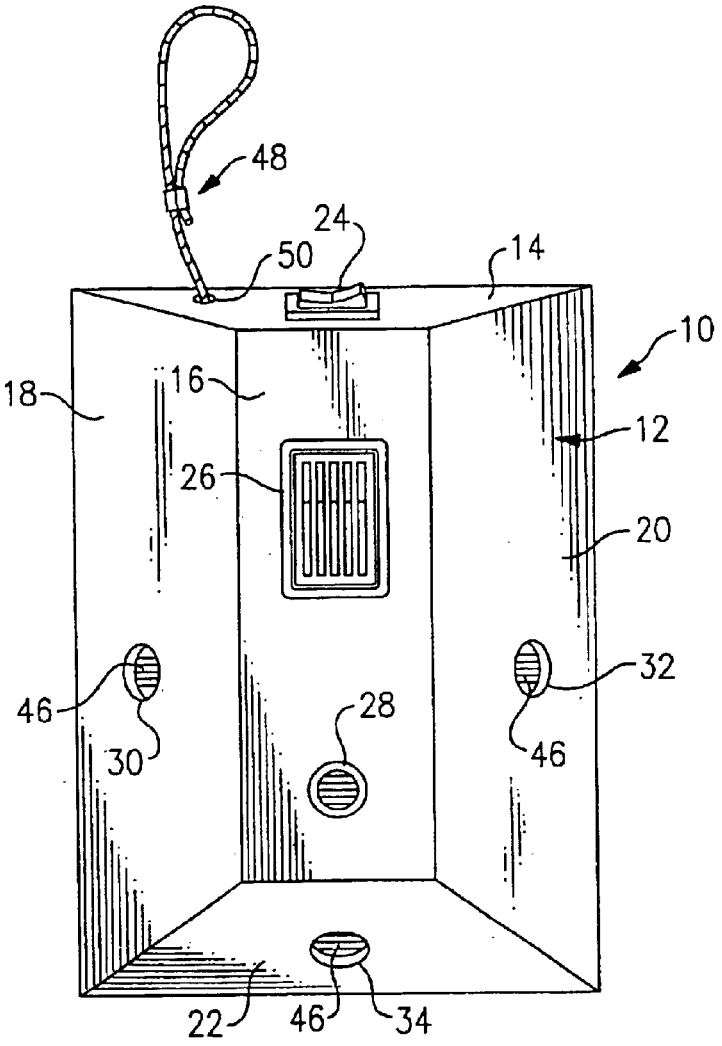
FIG. 1 shows a front perspective view of a firefighter's audible and visible marker beacon device according to one preferred embodiment of this invention.
Figure 3:
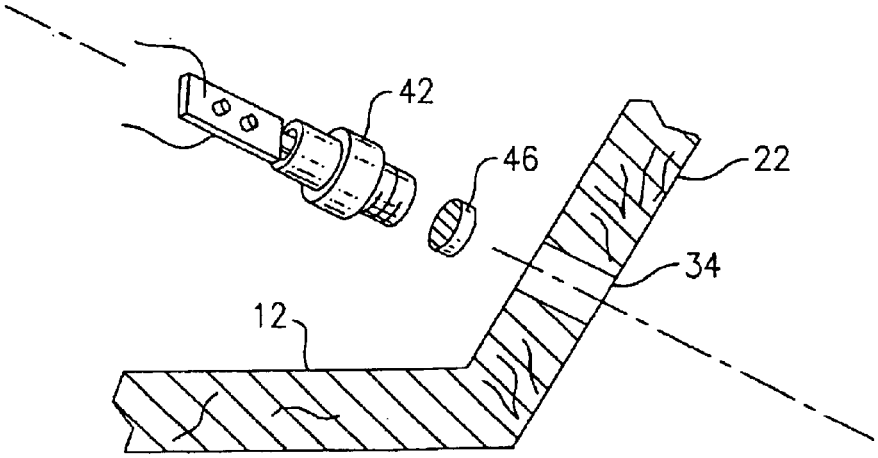
FIG. 3 is a partial assembly view showing one laser diode and associated lenticular device positioned in a respective penetration or aperture in one wall portion of the housing of this embodiment.
Figure 2:
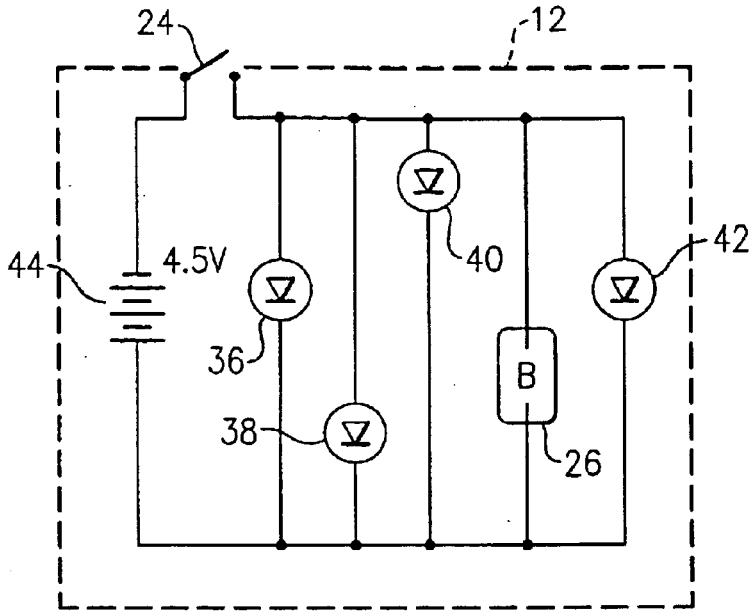
FIG. 2 is a schematic circuit diagram for this embodiment.

With reference now to the Drawing, and initially to FIGS. 1 to 3 thereof, an emergency light beam and sounder device 10 has a shell or housing 12 of a durable material capable of withstanding the shocks and other stresses expected in connection with fighting a fire in a burning building. Here, the housing 12 is generally wedge shaped, with a flat top wall 14, a forward facing front center panel 16, left panel 18 and right panel 20 that are angulated at about 135 degrees in respect to the center panel so as to face 45 degrees from the center, and a lower panel 22 that is also angulated at 135 degrees to the center panel so as to face 45 degrees downward. An on-off switch 24 is located on the top panel 14 and a sounder 26 is situated in the front center panel 16. There are round openings or penetrations 28, 30, 32, and 34 in the front center, left, right, and lower panels 16, 18, 20 and 22, respectively, each being provided for a respective laser diode, to be discussed shortly. As shown in FIG. 2, an electrical circuit, which is situated inside the housing 12, powers four laser diodes 36, 38, 40 and 42 (which are disposed in the openings 28, 30, 32, and 34, respectively), as well as the sounder 26. The circuit also incorporates a battery 44, here providing 4.5 volts DC, and the on-off switch 24. While the laser diodes are represented here with simple diodes, it is understood that these are intended to be somewhat more complex devices, the details of which are outside the scope of the present invention. As shown in FIG. 3, which illustrates one of the laser diodes 42 situated with an optic axis that projects through its respective opening or penetration 34 in the housing. The laser diodes are preferably Class III lasers, with a red or green wavelength. A lenticular device or lens 46 (which can be a complex assembly of various lens elements) is situated in the penetration 34, and serves the purpose of diffracting the laser beam from the laser diode 42 so that it fans out to produce a flat pane or sheet of light as it emerges. This pane of light, when it falls upon a surface such as a wall or floor, will create a line that leads back in the direction of the emergency device 10, that is, back to the exit alongside which the firefighter has affixed the device. Thus, the respective laser diodes each have their associated lens 46 oriented so as to diffract the laser light into a desired plane. The panes of light may draw a line across the floor, up an Opposing wall, and back across the ceiling.

As also shown in FIG. 1, a loop or lanyard 48 of a tough, durable material, e.g., steel cable, is disposed inside the body or housing 12, and protrudes out through an opening 50 on the top panel 14 of the device. This lanyard 48 can be pulled out when needed, and provides a means for hanging the device on a suitable projection from a wall, door frame, or window frame, where such a projection happens to be available. The lanyard 48 also lets the firefighter hang the device below an entrance opening, such as a basement window, where it can be supported from the outside.

Figure 4:
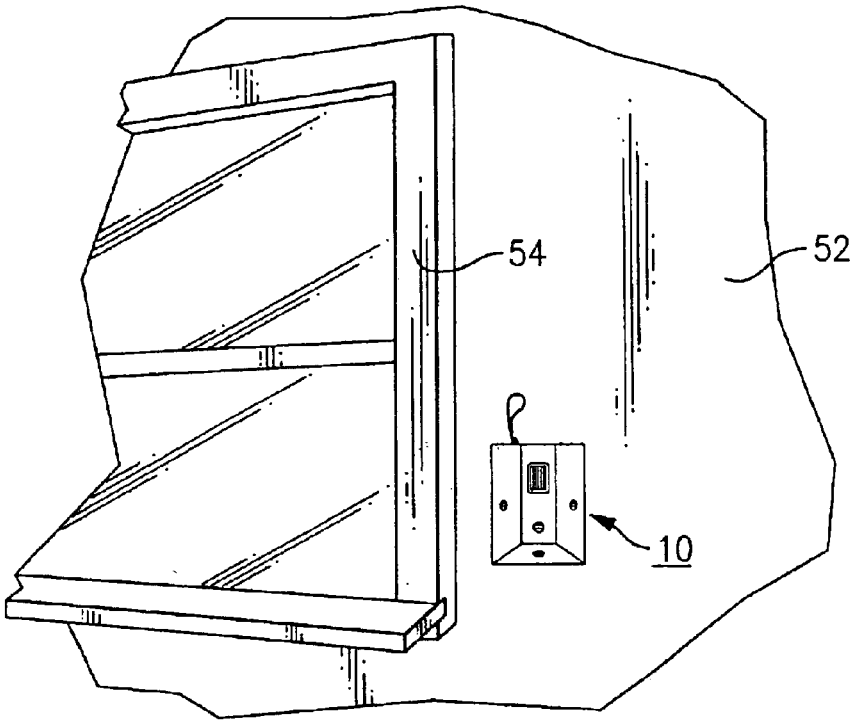
FIG. 4 is a perspective view showing the device of this embodiment mounted on a wall next to a window exit.

FIG. 4 shows the device 10 of this embodiment mounted on a vertical wall 52 adjacent a window frame 54. This can be achieved using the features shown in FIGS. 5 and 6.

Figure 5:
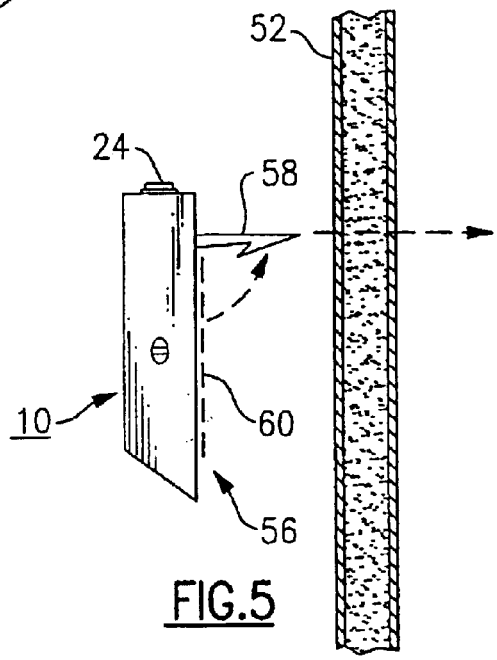
FIGS. 5 and 6 are side and back views of the device of this embodiment illustrating the means for mounting the device on a vertical surface.
Figure 6:
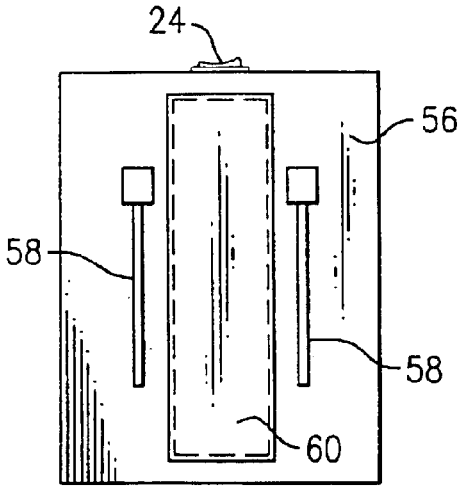

As illustrated in FIG. 5 and FIG. 6, a back wall 56 of the housing 12 is generally flat, and there is a pair of pivoted prongs or blades 58, which can be manipulated to swing up, and can be stabbed into wall material, e.g., drywall, to mount the device 10 onto the wall 52. Also shown here is an adhesive pad 60, with a removable contact material covering, that can be used to mount the device adhesively onto a vertical surface that is not suited to be penetrated by the prongs 58, e.g., a steel, concrete, or glass surface. The prongs or other blades, spikes, or the like can take on a variety of forms to serve the purpose of mounting the device suitably adjacent an exit so as to mark if for the firefighter.

Figure 7:
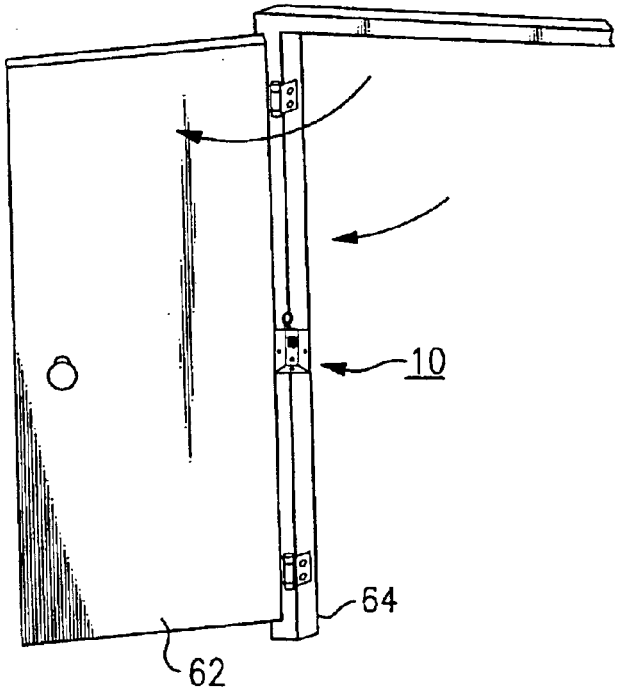
FIG. 7 shows a door being wedged open using the device of this embodiment.

FIG. 7 illustrates the emergency light and sounder device 10 of this embodiment being employed in a doorway, to wedge between the door 62 and door frame 64 on the hinge side, so that the door 62 remains open as a means of exit for the firefighter. Owing to the wedge shape of the device housing 12, the device can also be used at the bottom of the door, to wedge between the door and the floor to prop the door open.

Figure 8:
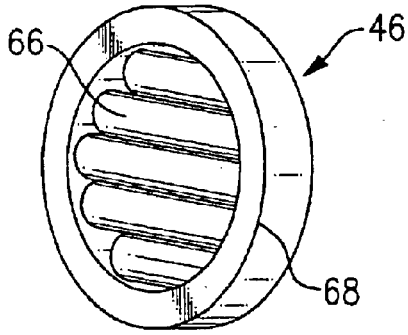
FIG. 8 illustrates one possible lenticular device that may be employed in embodiments of this invention.

Detail of the lens 46 of this specific embodiment is shown in FIG. 8. Here, the lens is made of a number of parallel cylindrical elements 66, supported in a ring 68 or similar frame.

While the door has been described with reference to a specific preferred embodiment, the invention is certainly not limited to that precise embodiment. Rather, many modifications and variations will become apparent to persons of skill in the art without departure from the scope and spirits of this invention, as defined in the appended claims.

We claim:

1. A portable emergency lighting device for firefighters for marking a door or window exit to a building structure so that the firefighter entering the building structure can find the door or window exit as a means of escape, comprising a housing having a front portion and a back wall, with a plurality of penetrations in said front portion;

a plurality of laser diodes within said housing and positioned to emit visible light through respective ones of said penetrations;

an audible sounder;

an electrical power supply within said housing for powering said laser diodes and said sounder; and means on the back wall of said housing permitting a firefighter to mount, without use of additional tools, said device onto a vertical wall surface near said door or window.

2. The portable emergency lighting device of claim 1 wherein the housing front portion has a wall portions angled about 45 degrees to the right and to the left, and a wall portion angled about 45 degrees below horizontal, with respective ones of said laser diodes positioned to emit light through ones of said penetrations in said angled wall portions.

3. The portable emergency lighting device of claim 1 wherein housing has a center wall portion, a left portion angled at about 135 degrees from said center wall portion, and a right portion angled at about 135 degrees from said center wall portion.

4. The portable emergency lighting device of claim 1 wherein said housing front portion has four facets oriented at respective different angles, and there are four of said laser diodes situated at respective penetrations in each of the four facets of said housing front portion.

5. The portable emergency lighting device of claim 1 wherein at one or more of said penetrations there is a lens for converting the beam of light of the associated laser diode into a flat pane of light.

6. The portable emergency lighting device of claim 1 wherein said means permitting the firefighter to mount the device onto a vertical wall surface includes one or more prongs on said back wall capable of penetrating through a sheet of drywall material.

7. The portable emergency lighting device of claim 6 wherein said at least one prong is pivotably mounted on said back wall to be rotated up from a vertical position into a horizontal position.

8. The portable emergency lighting device of claim 1 wherein said means permitting the firefighter to mount the device onto a vertical wall surface includes an adhesive pad affixed onto said back wall.

9. The portable emergency lighting device of claim 1 further comprising a flexible cord extending from said housing.

10. The portable emergency lighting device of claim 1 wherein said housing is tapered to have a wedge shape so that the device can be used for wedging a door into an open position.

* * * * *